United States Patent [19]

Holk et al.

[11] 4,439,081

[45] Mar. 27, 1984

[54] CONTAINER PRODUCED BY TRIPLE DRAWN METHOD USING TIN COATED STEEL

[75] Inventors: Albert J. Holk, Frankfort; Sam C. Pulciani, Norridge, both of Ill.

[73] Assignee: The Continental Group, Inc., New York, N.Y.

[21] Appl. No.: 52,176

[22] Filed: Jun. 26, 1979

[51] Int. Cl.[3] ..... B21D 51/26

[52] U.S. Cl. ..... 413/1; 220/62

[58] Field of Search ..... 113/120 A, 120 H; 204/37 T, 29, 34; 220/64, DIG. 11, 62, 470, 455, 454, 417; 428/612, 648; 427/328, 329, 433; 413/78, 69, 1

[56] References Cited

U.S. PATENT DOCUMENTS

| | | | |
|---|---|---|---|
| 2,434,290 | 1/1948 | Schutte | 428/612 |
| 3,174,917 | 3/1965 | Lesney et al. | 428/648 X |
| 3,367,751 | 2/1968 | Halley et al. | 428/648 |
| 3,505,040 | 4/1970 | Uchida et al. | 428/612 |
| 3,619,247 | 11/1971 | Newport et al. | 427/329 X |
| 3,934,527 | 1/1976 | Saunders | 113/120 A |
| 4,033,274 | 7/1977 | Beese | 113/120 A |

*Primary Examiner*—Mark Rosenbaum

*Attorney, Agent, or Firm*—Charles E. Brown

[57] ABSTRACT

A steel sheet container wherein the bottom wall is integral with the body and wherein the container is formed by a drawing operation with there being three drawings of the metal in sequence. Most particularly, the steel sheet has on the opposite surfaces thereof a coating of tin with the surfaces of the steel sheet being very smooth so as to permit the formation of the tin with a matte finish. The finish of the steel sheet should range generally from on the order of 10 microinch minimum to 30 microinch maximum.

8 Claims, 5 Drawing Figures

CONTAINER PRODUCED BY TRIPLE DRAWN METHOD USING TIN COATED STEEL

This invention relates in general to new and useful improvements in containers, and more particularly to a can which is drawn from sheet steel and has a body with an integral bottom.

It is well known to form cans with a bottom wall integral with the body by a triple drawing process wherein a flat steel blank is first drawn to a shallow, large diameter cup-shape and then is re-drawn to a deeper, smaller diameter cup-shape, and thereafter is drawn for a third time to the desired can body diameter and of a height for forming the desired can body. Such cans are commercially referred to as triple drawn containers.

Difficulties have been experienced in the forming of triple drawn containers from steel. This is due primarily to the work hardening of the steel resulting from the triple drawing process.

It has been found in accordance with this invention that tin coated steel may be beneficially used as opposed to other softer metals such as aluminum in triple drawn containers providing certain conditions are followed. A primary condition is that the steel sheet, prior to the tin coating thereof, is provided with a finish on the order of 30 microinch maximum. It has been found that when such high quality steel sheet is coated with tin, preferably by electroplating, it produces a matte finish, such steel sheets may be triple drawn without the work hardening being such as to result in cracking, particularly flange cracking. The smooth finish after tin coating allows the tin coated sheets to flow or to be formed from the blank to a cup-shape with a minimum amount of restriction or drag. Thus the work hardening is minimized.

It has been found also that if the steel sheet is formed from continuously cast or annealed steel, flange cracking and body wall fractures are greatly reduced. Ingot cast material has many inclusions, whereas continuously cast material has very few rolled-in inclusions. It is therefore highly beneficial that the steel sheet be a continuously cast and annealed sheet which has a finish both in the direction of grain and against the grain on the order of 30 microinch maximum.

It is to be understood that there is no limitation as to the fineness of the finish. On the other hand, a finish finer than on the order of 10 microinch minimum is not commercially feasible in that it would be too costly for the manufacture of cans.

With the above and other objects in view that will hereinafter appear, the nature of the invention will be more clearly understood by reference to the following detailed description, the appended claims, and the several views illustrated in the accompanying drawings.

IN THE DRAWINGS

Figure 2:
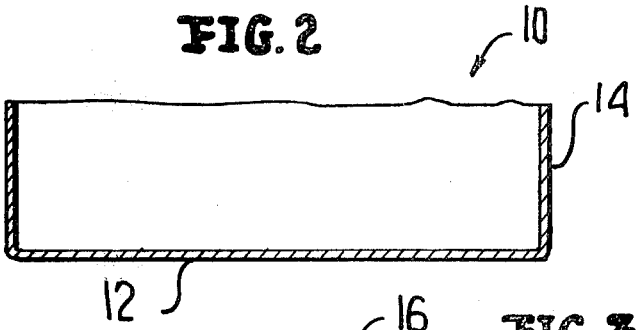
FIG. 2 is a vertical sectional view taken through a container after a first drawing operation.

Referring now to the drawings in detail, it is to be understood that in the formation of a container by a triple drawing operation, a flat sheet metal blank is first drawn to a very shallow, large diameter cup-shaped configuration such as the cup 10 of FIG. 2. The cup 10 includes a bottom wall 12 and an upstanding body 14. The body 14 is of a diameter much greater than that of the diameter of the intended can, and is very shallow.

Figure 3:
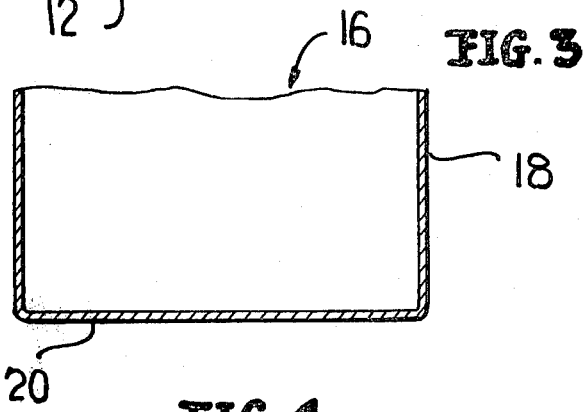
FIG. 3 is a sectional view similar to FIG. 2 and shows a like container after a second drawing operation.

In FIG. 3 there is illustrated the same component after a second drawing operation. The component is now identified by the numeral 16, and once again is generally cup-shaped. However, it includes a body 18 and an end wall 20 which are of a much lesser diameter than the body 14 and the end wall 12. On the other hand, the height of the body 18 has materially increased.

Figure 4:
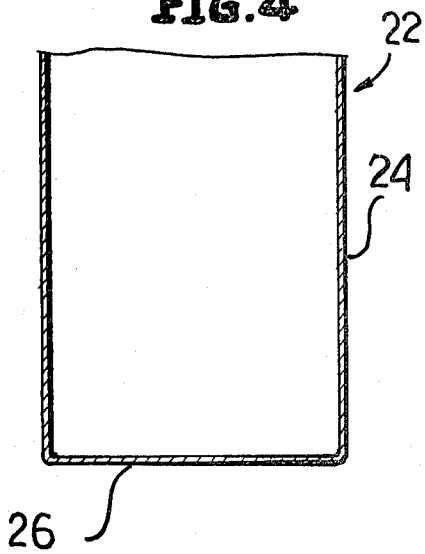
FIG. 4 is another sectional view similar to FIG. 2 and shows the container after a third drawing operation.

In FIG. 4 there is illustrated the component after a third drawing operation wherein the component is now in the form of a cup-shaped member 22 having a relatively small diameter body 24 and a like diameter bottom wall 26. The body 24 is now of the diameter desired for the final container product.

It is, however, necessary to change the cross section of the bottom wall 26 to increase the stiffness thereof. Also, it is necessary to trim the body 24 to the desired length and to flange the same for the customary reception of a closure unit and the formation of a double seam connection therewith.

Figure 5:
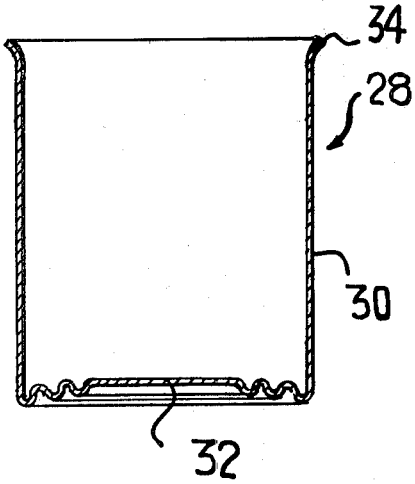
FIG. 5 is a sectional view through a container formed in accordance with this invention, and corresponds to the container of FIG. 4 after the bottom wall has been reshaped and after the free end of the body has been trimmed to length and flanged.

The triple drawn container formed in accordance with this invention is illustrated in FIG. 5 and is generally identified by the numeral 28. The container 28 includes a body 30 having an integral bottom wall 32. The bottom wall 32 has been suitably shaped so as to have the desired stiffness. The body 30 is now of the desired height and is provided at its free end with an outwardly directed flange 34 which is required for the formation of a double seam between the body and the end unit (not shown) formed in the customary manner.

The container 28 as thus generally described is conventional. However, such containers are normally restricted to be manufactured from a relatively soft metal such as aluminum. The aluminum can be thrice drawn without there being sufficient work hardening for there to be any problem with flange cracking and the like.

It is the purpose of this invention to be able to make the same type of triple drawn container from steel. In the past great difficulties have been experienced in drawing such container bodies from steel, both because of the inclusions rolled therein which caused undue cracking of the flange as well as undue body fractures. Further, the steel, in the triple drawing thereof, becomes so work hardened that it cannot be effectively flanged without undue cracking and therefore spoilage.

Figure 1:
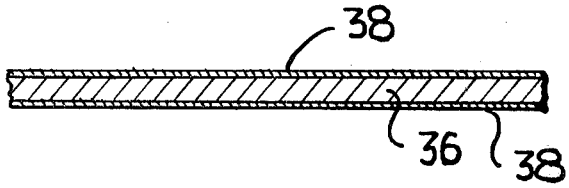
FIG. 1 is a sectional view taken through a tin coated steel sheet formed in accordance with this invention.

This invention most particularly has to do with the discovery that a specific type of metal can be beneficially utilized in the triple drawing process when the container is to be formed of steel sheet. In FIG. 1 there is illustrated a steel sheet 36 which has a tin coating 38 on the opposite faces thereof.

It has been most particularly found that the sheet 36, in order to avoid there being inclusions, should be formed of a continuously annealed and cast steel. This prevents any accidental cracking and rupture of the container either during use or in the working thereof to apply an end unit by a double seaming operation.

It has also been found that the finish of the tin coatings 38 is a controlling factor in the workability or drawability of the tin coated steel sheet. Most particularly, it has been found that if the base steel sheet is provided with a very fine finish, the tin coatings 38 may be applied to have the desired surface finish which will be such as to permit the tin coated steel readily to flow from its planar flat blank configuration to the desired cup-shape and then to be reduced in diameter by subsequent re-drawing operations without sufficient drag which would cause undue work hardening of the steel.

Most particularly, it has been found that if the steel sheet from which the cup-shaped member 10 is initially drawn has a finish on the order of 30 microinch at a maximum when the tine is coated therein, the resultant finish of the tin coating will be one which will permit the required flowing of the tin coating relative to the drawing dies without an undue work hardening of the steel.

Various finishes have been reviewed, and it might be said that the lower limit of finish is on the order of 10 microinch minimum, it is to be understood that the cost of obtaining a finer finish becomes too great to utilize the tin coated steel in the formation of containers. Thus it might be said that the finish of the steel sheet 36 should be within the range of 10 microinch to 30 microinch so that the desired tin coating may be applied to have a finish of the same order with the finish of the tin being a matte finish. By providing the steel sheet with a finish which will permit the ready flow of the tin coated steel within a drawing die, it will be seen that there will be a minimum heating of the sheet material and working thereof during the triple drawing operation, and therefore the required container configuration can be obtained by the triple drawing process without there being an undue work hardening of the steel.

Although only a preferred embodiment of the invention has been specifically illustrated and described herein, it is to be understood that minor variations may be made in the blank material from which the container is formed without departing from the spirit and scope of the invention as described in the appended claims.

We claim:

1. In the method of forming a can including a body and an integral end wherein a steel sheet blank is first drawn to form a large diameter shallow cup, then redrawn to form a deeper smaller diameter cup, and thereafter redrawn to the final can body diameter; the improvement of starting with a tin coated steel sheet wherein the steel sheet prior to coating has a surface finish on the order of 30 microinch maximum.

2. The method of claim 1 wherein said 30 microinch finish is both in the direction of the grain and against the grain.

3. The method of claim 1 wherein said steel is continuously cast steel.

4. The method of claim 1 wherein said steel is continuously cast and continuously annealed steel.

5. A can comprising a drawn body having an integral bottom, said can being formed of tin coated steel and being improved by the steel per se having a surface finish on the order of 30 microinch maximum.

6. The can of claim 5 wherein said steel is a continuously cast steel.

7. The can of claim 5 wherein said steel is a continuously cast and annealed steel.

8. The can of claim 5 wherein said 30 microinch finish is both in the direction of the grain and against the grain.

* * * * *